US008038855B2

(12) United States Patent
Sandoval et al.

(10) Patent No.: US 8,038,855 B2
(45) Date of Patent: Oct. 18, 2011

(54) ANODE STRUCTURE FOR COPPER ELECTROWINNING

(75) Inventors: Scot P. Sandoval, Morenci, AZ (US); Casey J. Clayton, Morenci, AZ (US); Timothy G. Robinson, Scottsdale, AZ (US); Christopher John Zanotti, North Royalton, OH (US); Martin Kim Zanotti, Parma Heights, OH (US)

(73) Assignee: Freeport-McMoran Corporation, Phoenix, AZ (US)

( * ) Notice: Subject to any disclaimer, the term of this patent is extended or adjusted under 35 U.S.C. 154(b) by 240 days.

(21) Appl. No.: 12/432,473

(22) Filed: Apr. 29, 2009

(65) Prior Publication Data

US 2010/0276281 A1 Nov. 4, 2010

(51) Int. Cl.
*C25B 11/02* (2006.01)

(52) U.S. Cl. ..... 204/288; 204/286.1; 204/289; 204/281; 29/745; 29/746; 29/747; 29/755; 29/879

(58) Field of Classification Search ..... 204/281, 204/286.1, 288, 289; 29/825, 879, 745, 746, 29/747, 755
See application file for complete search history.

(56) References Cited

U.S. PATENT DOCUMENTS

| | | | | |
|---|---|---|---|---|
| 2,792,342 | A | | 5/1957 | Tuwiner |
| 3,671,415 | A | | 6/1972 | King |
| 3,682,798 | A | | 8/1972 | Tuddenham et al. |
| 3,746,631 | A | | 7/1973 | Glos |
| 3,839,179 | A | | 10/1974 | Koziol |
| 3,857,774 | A | | 12/1974 | Morton et al. |
| 3,907,659 | A | | 9/1975 | Paige |
| 3,915,834 | A | | 10/1975 | Wright et al. |
| 3,928,167 | A | | 12/1975 | Buoy |
| 3,972,795 | A | | 8/1976 | Goens et al. |
| 4,014,763 | A | | 3/1977 | Lowe |
| 4,039,403 | A | | 8/1977 | Astley et al. |
| 4,121,994 | A | * | 10/1978 | Crippen et al. ..... 29/592.1 |
| 4,134,806 | A | | 1/1979 | De Nora |
| 4,186,074 | A | | 1/1980 | Perry |
| 4,211,629 | A | | 7/1980 | McCutchen |
| 4,226,685 | A | | 10/1980 | Portal et al. |
| 4,230,545 | A | | 10/1980 | Prengaman |
| 4,236,978 | A | | 12/1980 | Prengaman |
| 4,251,337 | A | | 2/1981 | Orr et al. |
| 4,260,470 | A | | 4/1981 | Fisher |

(Continued)

FOREIGN PATENT DOCUMENTS

EP 0 534 011 3/1993

(Continued)

OTHER PUBLICATIONS

The International Search Report and Written Opinion from corresponding PCT Application No. PCT/US2009/044344 dated Jul. 29, 2009.

*Primary Examiner* — Bruce Bell
(74) *Attorney, Agent, or Firm* — Snell & Wilmer L.L.P.

(57) ABSTRACT

An electrode for use in producing copper in either a conventional electrowinning cell or the direct electrowinning cell is provided. The electrode includes a hanger bar and an electrode body coupled with the hanger bar. The electrode body includes at least one conductor rod having a core and an outer layer surrounding the core and a substrate coupled with the conductor rod.

20 Claims, 12 Drawing Sheets

U.S. PATENT DOCUMENTS 4,269,687 A 5/1981 Gilbert et al.
4,272,339 A 6/1981 Knight et al.
4,319,977 A 3/1982 Wortley
4,364,811 A 12/1982 Fabian
4,373,654 A 2/1983 Prengaman
4,391,695 A 7/1983 Koziol
4,411,762 A 10/1983 Kline
4,459,189 A 7/1984 Vance
4,460,450 A 7/1984 Koziol
4,517,065 A 5/1985 Guerriero
4,543,174 A 9/1985 Beer
4,543,348 A 9/1985 Beer et al.
4,606,804 A 8/1986 Schulke et al.
4,610,773 A 9/1986 Takayasu
4,642,173 A 2/1987 Koziol
4,661,232 A 4/1987 Koziol
4,871,436 A 10/1989 Hartog
4,882,027 A 11/1989 Borst
4,925,543 A 5/1990 Ginatta
4,936,971 A 6/1990 Pohto
5,031,290 A 7/1991 Brereton
5,135,633 A 8/1992 Kotowski
5,156,726 A 10/1992 Nakada
5,172,850 A 12/1992 Prengaman
5,451,307 A 9/1995 Bennett
5,464,519 A 11/1995 Tomba
5,584,975 A 12/1996 Pohto
5,619,793 A 4/1997 Tomba
5,679,240 A 10/1997 Anastasijevic
5,783,050 A 7/1998 Coin
5,783,053 A 7/1998 Tomba
5,919,343 A * 7/1999 Sparapani ..... 204/288.1
5,972,181 A 10/1999 Coin et al.
5,989,396 A 11/1999 Prasnikar
6,086,691 A 7/2000 Lehockey et al.
6,129,822 A 10/2000 Ferdman
6,131,798 A 10/2000 Prengaman
6,139,705 A 10/2000 Brown, Jr. et al.
6,224,723 B1 5/2001 Prengaman
6,287,433 B1 9/2001 Sapozhnikova
6,352,622 B1 3/2002 Brown et al.
6,368,489 B1 4/2002 Hardee et al.
6,527,939 B1 3/2003 Hardee
6,569,300 B1 * 5/2003 Assenmacher ..... 204/286.1
6,802,948 B2 10/2004 Hardee
7,247,229 B2 7/2007 Hardee
7,258,778 B2 8/2007 Hardee
7,344,624 B2 3/2008 Aslin
7,368,049 B2 * 5/2008 Sandoval et al. ..... 205/576
7,378,010 B2 * 5/2008 Stevens et al. ..... 205/574
7,393,438 B2 * 7/2008 Marsden et al. ..... 204/269
7,452,455 B2 * 11/2008 Sandoval et al. ..... 205/579
7,494,580 B2 * 2/2009 Sandoval et al. ..... 205/576
7,591,934 B2 * 9/2009 Marsden et al. ..... 204/269
7,736,475 B2 * 6/2010 Sandoval et al. ..... 204/237
7,736,476 B2 * 6/2010 Gilbert et al. ..... 204/278.5
7,736,486 B2 * 6/2010 Stevens et al. ..... 205/576
2004/0063966 A1 4/2004 Rautenstrauch et al.
2006/0016684 A1 1/2006 Marsden
2006/0102470 A1 5/2006 Robinson et al.
2009/0288856 A1 * 11/2009 Sandoval et al. ..... 174/126.2
2009/0288958 A1 * 11/2009 Sandoval et al. ..... 205/576

FOREIGN PATENT DOCUMENTS

GB 2000710 A 1/1979
GB 2027452 A 2/1980
GB 2040311 A 8/1980

* cited by examiner

ANODE STRUCTURE FOR COPPER ELECTROWINNING

FIELD OF THE INVENTION

The present invention generally relates to an apparatus for producing copper using electrowinning, and relates more specifically to an electrode apparatus for use in an electrowinning cell.

BACKGROUND

Efficiency and cost-effectiveness of copper electrowinning is, and for a long time has been, important to the competitiveness of the copper industry. Research and development efforts in this area have thus focused, at least in part, on mechanisms for decreasing the total cost for anodes used in copper electrowinning, which directly impact the cost-effectiveness of the electrowinning process.

One type of anode employed in an electrowinning operation typically comprises a lead or a lead alloy, such as, for example, Pb—Sn—Ca. One significant disadvantage of using such anodes is lead contamination of the copper cathodes. Specifically, during the electrowinning operation, small amounts of lead are released from the surface of the anode and ultimately cause the generation of undesirable sediments, sludges, particulates suspended in the electrolyte, other corrosion products, or other physical degradation products in the electrochemical cell and contamination of the copper product. Another disadvantage of using lead anodes in conventional electrowinning processes is the need to add cobalt sulfate to the copper electrolyte to help stabilize lead-based anodes for at least one of control of surface corrosion characteristics of the anode, control of formation of lead oxide, and/or prevention of deleterious effects of manganese in the system. Improvements are needed in the materials used for anodes useful for electrochemical reactions, as well as in the construction of the anodes.

SUMMARY

Accordingly, in various embodiments, the present invention provides a new design for an anode structure for use in electrowinning cells. In an aspect of an exemplary embodiment, the present invention provides an anode for an electrowinning cell that accommodates flow-through anodes and conventional cathodes. This allows for the production of high quality copper from copper-containing solutions using either a conventional electrowinning process or a direct electrowinning process.

In accordance with various embodiments, the present invention provides an electrode for producing copper in an electrowinning cell. The electrode includes a hanger bar and an electrode body including at least one conductor rod and a substrate, a connection coupling the hanger bar and the at least one conductor rod, and a seal isolating the connection. In an exemplary embodiment, the at least one conductor rod has an inner core and an outer layer surrounding a portion of the inner core. In an exemplary embodiment, at least one perforated substrate can be coupled to the at least one conductor rod. The present invention offers significant economic benefits in manufacturing and/or electrode lifetime as compared to prior art electrodes without sacrificing functionality.

Further areas of applicability will become apparent from the description provided herein. It should be understood that the description and specific examples are intended for purposes of illustration only and are not intended to limit the scope of the present invention.

BRIEF DESCRIPTION OF THE DRAWINGS

The drawings described herein are for illustration purposes only and are not intended to limit the scope of the present disclosure in any way. The present invention will become more fully understood from the detailed description and the accompanying drawings wherein.

DETAILED DESCRIPTION

Figure 1:
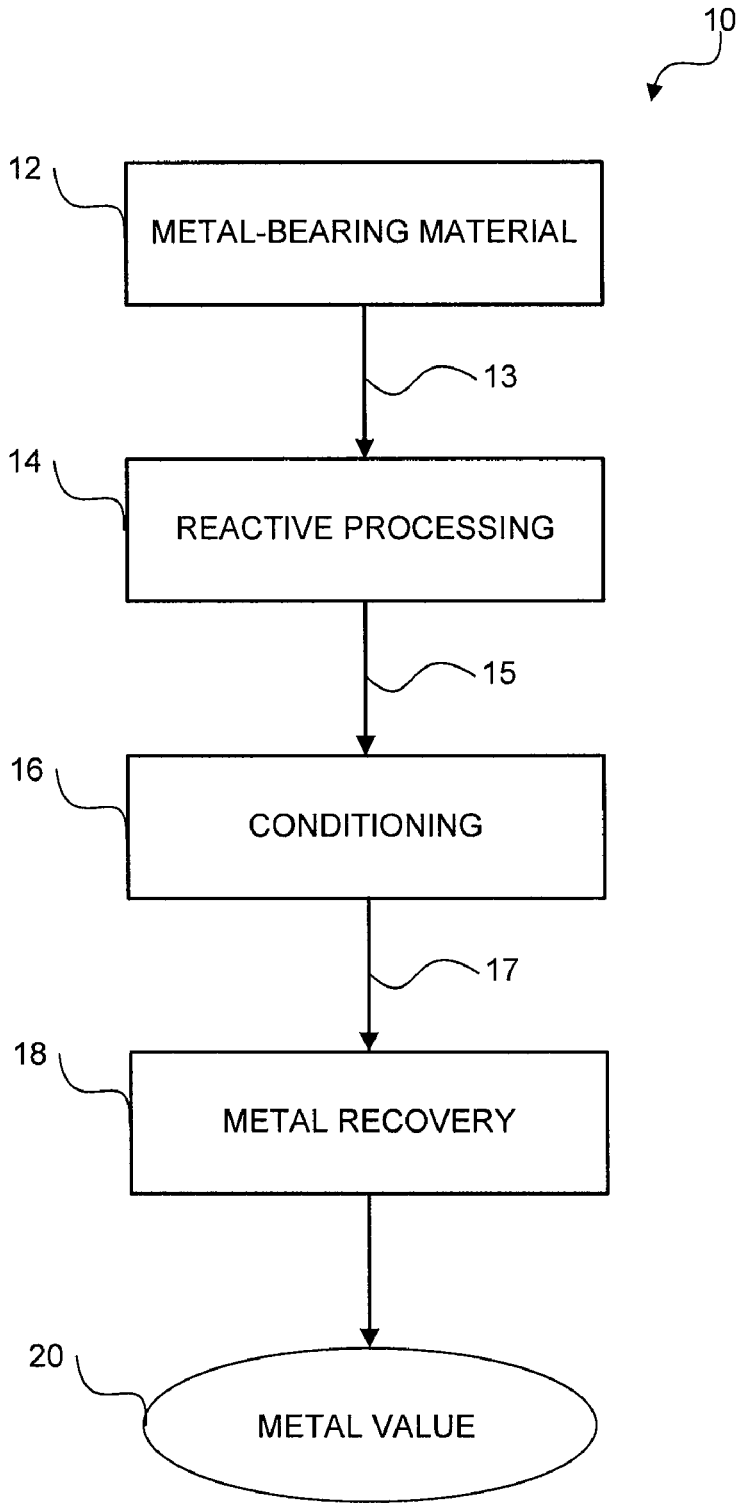
FIG. 1 is a flow chart illustrating a process of metal value recovery, according to various embodiments of the present invention.

The following description is merely exemplary in nature and is not intended to limit the present invention, its applications, or its uses. It should be understood that throughout the drawings, corresponding reference numerals indicate like or corresponding parts and features. The description of specific examples indicated in various embodiments of the present invention are intended for purposes of illustration only and are not intended to limit the scope of the invention disclosed herein. Moreover, recitation of multiple embodiments having stated features is not intended to exclude other embodiments having additional features or other embodiments incorporating different combinations of the stated features.

Various embodiments of the present invention are an improvement to a conventional electrode for an electrolytic cell. The present invention exhibits significant advancements over prior art apparatus, enables significant improvements in copper product quality and process efficiency, and/or provides economic benefits. Moreover, existing copper recovery processes that utilize lead-based anodes or conventional titanium anodes in conventional electrowinning apparatus may, in many instances, be retrofitted to exploit the many commercial benefits that the present invention can provide.

An electrowinning cell as described herein may be configured for the extraction of a variety of metal values. In the case of electrowinning, a current is passed through an anode through the electrolyte solution or metal-bearing solution containing the metal value so that the metal value is extracted as it is deposited in an electroplating process onto the cathode. In general, electrowinning metal values can include, but are not limited to, copper, gold, silver, zinc, nickel, chromium, cobalt, manganese, rare earth metals, and alkaline metals. Although various examples included in this disclosure discuss the use of an anode in the electrowinning of copper, the anode described herein, in accordance to the present invention, may be used in the electrowinning of any metal value.

Referring to FIG. 1, in accordance with various aspects of the present invention, a metal-bearing material 12 is provided for processing in accordance with metal recovery process 10. Metal-bearing material 12 may be an ore, a concentrate, or any other material from which metal values may be recovered. Metal values such as, for example, copper, gold, silver, zinc, platinum group metals, nickel, cobalt, molybdenum, rhenium, uranium, rare earth metals, and the like may be recovered from metal-bearing material 12 in accordance with various embodiments of the present invention. Various aspects and embodiments of the present invention, however, prove especially advantageous in connection with the recovery of copper from copper sulfide ores, such as, for example, chalcopyrite ($CuFeS_2$), chalcocite ($CU_2S$), bornite ($Cu_5FeS_4$), covellite ($CuS$), enargite ($Cu_3AsS_4$), digenite ($CU_9S_5$), mixtures thereof and/or concentrates thereof. In addition, various aspects and embodiments of the present invention also prove advantageous in connection with the recovery of copper from copper oxide ores and/or concentrates thereof. Still further, various aspects and embodiments of the present invention prove advantageous in the recovery of any of the electrowinning metals, as listed herein, such as for example cobalt or zinc, from ores and/or concentrates thereof. Thus, in various embodiments, metal-bearing material 12 is a copper ore or concentrate, and in an exemplary embodiment, metal-bearing material 12 is a copper sulfide ore or a copper oxide ore, mixture thereof, or concentrates thereof.

In various embodiments, processed metal-bearing material 15 may comprise metal-bearing material 12 prepared for metal recovery process 10 in any manner that enables the conditions of processed metal-bearing material 13 to be suitable for a chosen processing method, as such conditions may affect the overall effectiveness and efficiency of processing operations. Desired composition and component concentration parameters may be achieved through a variety of chemical and/or physical processing stages, the choice of which will depend upon the operating parameters of the chosen processing scheme, equipment cost and material specifications. For example, metal-bearing material 12 may undergo comminution, flotation, blending, and/or slurry formation, as well as chemical and/or physical conditioning to produce processed metal-bearing material 13. In an exemplary embodiment, processed metal-bearing material 13 is a concentrate.

With continued reference to FIG. 1, after metal-bearing material 12 has been suitably prepared, processed metal-bearing material 13 is subjected to reactive processing step 14 to put a metal value or metal values in processed metal-bearing material 13 in a condition for later metal recovery steps, namely metal recovery 18. For example, exemplary suitable processes include reactive processes that tend to liberate the desired metal value or metal values from the metal-bearing material 12. In accordance with an exemplary embodiment of the present invention, reactive processing step 14 may comprise leaching. Leaching can be any method, process, or system that enables a metal value to be leached from processed metal-bearing material 13. Typically, leaching utilizes acid to leach a metal value from processed metal-bearing material 13. For example, leaching can employ a leaching apparatus such as for example, a heap leach, a vat leach, a tank leach, a pad leach, a leach vessel or any other leaching technology useful for leaching a metal value from processed metal-bearing material 13.

In accordance with various embodiments, leaching may be conducted at any suitable pressure, temperature, and/or oxygen content. Leaching can employ one of a high temperature, a medium temperature, or a low temperature, combined with one of high pressure, or atmospheric pressure. Leaching may utilize conventional atmospheric or pressure leaching, for example but not limited to, low, medium or high temperature pressure leaching. As used herein, the term "pressure leaching" refers to a metal recovery process in which material is contacted with an acidic solution and oxygen under conditions of elevated temperature and pressure. Medium or high temperature pressure leaching processes for chalcopyrite are generally thought of as those processes operating at temperatures from about 120° C. to about 190° C. or up to about 250° C. In accordance with various embodiments of the present invention, reactive processing step 14 may comprise any type of reactive process to put a metal value or values in processed metal-bearing material 13 in a condition to be subjected to later metal recovery steps.

In various embodiments, reactive processing step 14 provides a metal-bearing slurry 15 for conditioning 16. In various embodiments, conditioning 16 can be, for example, but is not limited to, a solid liquid phase separation step, an additional leach step, a pH adjustment step, a dilution step, a concentration step, a metal precipitation step, a filtering step, a settling step, and the like, as well as combinations thereof. In an exemplary embodiment, conditioning 16 can be a solid liquid phase separation step configured to yield a metal-bearing solution 17 and a metal-bearing solid.

In other various embodiments, conditioning 16 may be one or more leaching steps. For example, conditioning 16 may be any method, process, or system that further prepares metal-bearing material 12 for recovery. In various embodiments, conditioning 16 utilizes acid to leach a metal value from a metal-bearing material 12. For example, conditioning 16 may employ a leaching apparatus such as for example, a heap leach, a vat leach, a tank leach, a pad leach, a leach vessel or any other leaching technology useful for leaching a metal value from a metal-bearing material 12.

In accordance with various embodiments, conditioning 16 may be a leach process conducted at any suitable pressure, temperature, and/or oxygen content. In such embodiments, conditioning 16 may employ one of a high temperature, a medium temperature, or a low temperature, combined with one of high pressure, or atmospheric pressure. Conditioning 16 may utilize conventional atmospheric or pressure leaching, for example but not limited to, low, medium or high temperature pressure leaching. Medium or high temperature pressure leaching processes for chalcopyrite are generally thought of as those processes operating at temperatures from about 120° to about 190° C. or up to about 250° C.

In various embodiments, conditioning 16 may comprise dilution, settling, filtration, solution/solvent extraction, ion exchange, pH adjustment, chemical adjustment, purification, concentration, screening, and size separation. In various embodiments, conditioning 16 is a high temperature, high pressure leach. In other embodiments, conditioning 16 is an atmospheric leach. In further embodiments, conditioning 16 is a solid liquid phase separation. In still further embodiments, conditioning 16 is a settling/filtration step. In various embodiments, conditioning 16 produces metal-bearing solution 17.

In various embodiments, metal-bearing solution 17 may be subjected to metal recovery 18 to yield metal value 20. In exemplary embodiments, metal recovery 18 can comprise electrowinning metal-bearing solution 17 to yield recovered metal value 20 as a cathode. In one exemplary embodiment, metal recovery 18 may be configured to employ conventional electrowinning processes and include a solvent extraction step, an ion exchange step, an ion selective membrane, a solution recirculation step, and/or a concentration step. In one preferred embodiment, metal recovery 18 may be configured to subject metal-bearing solution 17 to a solvent extraction step to yield a rich electrolyte solution, which may be subject to an electrowinning circuit to recover a desired metal value 20. In another exemplary embodiment, metal recovery 18 may be configured to employ direct electrowinning processes without the use of a solvent extraction step, an ion exchange step, an ion selective membrane, a solution recirculation step, and/or a concentration step. In another preferred embodiment, metal recovery 18 may be configured to feed metal-bearing solution 17 directly into an electrowinning circuit to recover a desired metal value 20. In an especially preferred embodiment, metal value 20 is copper.

For the sake of convenience and a broad understanding of the present invention, an electrowinning circuit useful in connection with various embodiments of the present invention may comprise an electrowinning circuit, constructed and configured to operate in a conventional manner. The electrowinning circuit may include a plurality of electrowinning cells, each cell may be constructed as an elongated rectangular tank or vessel containing alternating cathodes and anodes, arranged perpendicular to the long axis of the tank. A metal-bearing solution may be provided to the tank, for example at one end, to flow perpendicular to the plane of the parallel anodes and cathodes. With the application of current from a power supply, a metal value, such as for example, copper, can be deposited at the cathodes, and water can be electrolyzed to form oxygen and protons at the anodes.

Figure 2:
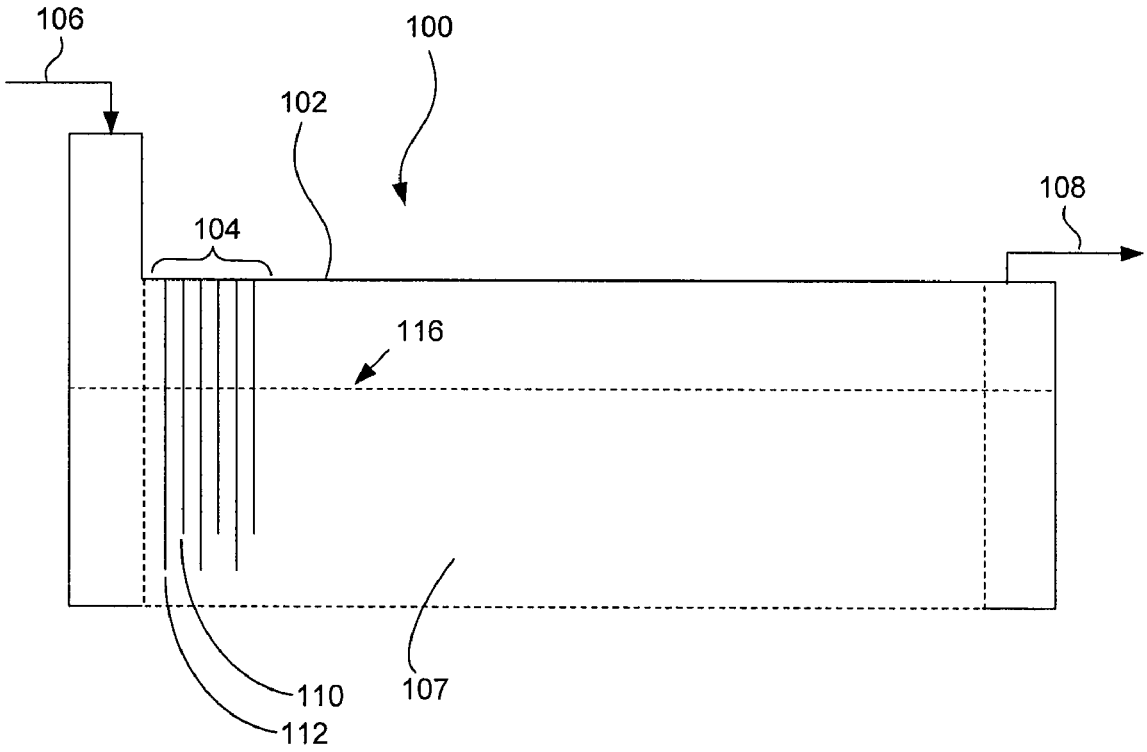
FIG. 2 is a cross sectional view illustrating an electrowinning cell, in accordance with various embodiments of the present invention.

With initial reference to FIG. 2, an exemplary electrowinning cell 100 is illustrated in accordance with various embodiments of the present invention. Electrowinning cell 100 comprises vessel 102 configured to hold a series of electrodes 104. Power supply (not pictured) can be coupled to series of electrodes 104. In various embodiments, series of electrodes 104 can comprise a plurality of alternating anodes 112 and cathodes 110. As understood by one of ordinary skill in the art, any number of anodes 112 and/or cathodes 110 may be utilized. In addition an electrowinning circuit may comprise an individual electrowinning cell 100 or a plurality of electrowinning cells 100 connected in series or in parallel.

Typically, metal-bearing electrolytic solution 107 enters through entry port 106 at one end and flows through cell 100 (and thus past electrodes 104), during which a metal value is electrowon from metal-bearing electrolytic solution 107 onto cathode 110. An active surface or area of each of the series of electrodes 104 is the portion of each of the series of electrodes 104 that is immersed in metal-bearing electrolytic solution 107 up to solution fill level 116. In an exemplary embodiment, metal-bearing electrolytic solution 107 is metal-bearing solution 17. In a preferred embodiment, metal-bearing electrolytic solution 107 comprises at least copper. Lean electrolyte (metal-bearing electrolytic solution 107 having a reduced concentration of metal value) exits at exit port 108 of cell 100 at a distal end. In accordance with one aspect of an exemplary embodiment of the present invention, at least a portion of lean electrolyte may be returned to cell 100. In another aspect of an exemplary embodiment, at least a portion of lean electrolyte can be returned to at least one of reactive processing 14 and conditioning 16.

The general process of copper electrowinning, wherein copper is plated from a copper electrolyte, such as for example metal-bearing electrolytic solution 107, to a substantially pure cathode in an aqueous electrolyte is believed to occur by the following reactions:

Cathode reaction:

$$Cu^{2+}+SO_4^{2-}+2e^- \rightarrow Cu^0+SO_4^{2-} (E^0=+0.340\ V)$$

Anode reaction:

$$H_2O \rightarrow \tfrac{1}{2}O_2+2H^++2e^- (E^0=+1.230\ V)$$

Overall cell reaction:

$$Cu^{2+}+SO_4^{2-}+H_2O \rightarrow Cu^0+2H^++SO_4^{2-}+\tfrac{1}{2}O_2\ (E^0=+0.890\ V)$$

Conventional copper electrowinning operations use either a copper starter sheet or a stainless steel "blank" or titanium "blank" as the cathode 110. In accordance with one aspect of an exemplary embodiment of the present invention, the cathode 110 is configured as a metal sheet. The cathode 110 may be formed of copper, copper alloy, stainless steel, titanium, or another metal or combination of metals, alloys, and/or other suitable materials. As illustrated in FIG. 2 and as is generally well known in the art, cathode 110 is typically suspended from the top of electrochemical cell 100 such that a portion of cathode 110 is immersed below solution fill level 116 in metal-bearing electrolytic solution 107, as discussed above. This active surface is the portion of cathode 110 onto which a metal value, such as copper, is plated during electrowinning.

In general, electrowinning chemistry and electrowinning apparatus for copper value recovery are known in the art. As with conventional electrowinning cells, the rate at which direct current can be passed through cell 100 is effectively limited by the rate at which copper ions can pass from the copper-bearing solution to the cathode surface. This rate, also known as the limiting current density, is a function of factors such as copper concentration, diffusion coefficient of copper, cell configuration, and level of agitation of the aqueous copper-bearing solution. Conventional electrowinning operations typically operate at current densities in the range of about 220 to about 380 Amps per square meter ("$A/m^2$") or of about 20 Amps per square foot ("$A/ft^2$") of active cathode, and more typically in the range of about 300 $A/m^2$ and about 350 $A/m^2$ or of about 28 $Aft^2$ and about 32 $A/ft^2$. Use of an electrolytic solution flow system, which can provide additional electrolyte circulation and/or air injection into an electrochemical cell 100, can allow for higher current densities to be achieved.

In accordance with an exemplary embodiment of the present invention, overall cell voltage in a range of from about 0.75 Volts ("V") to about 3.0 V can be achieved, preferably less than about 1.9 V, and more preferably less than about 1.7 V. The overall cell voltage achievable can be dependent upon a number of factors, including spacing of the series of electrodes 104, the configuration and materials of construction of the series of electrodes 104, acid concentration and metal value concentration in the electrolytic solution 107, current density, electrolytic solution 107 temperature, electrolytic solution 107 conductivity, and, to a smaller extent, the nature and amount of any additives to the electrowinning process (such as, for example, flocculants, smoothing agents, and/or surfactants.

Generally speaking, as the operating current density in the electrochemical cell 100 increases, the metal value plating rate onto cathode 110 increases. Stated another way, as the operating current density increases, more cathode 110 of the metal value, for example, copper, is produced for a given time period on cathode active surface area than when a lower operating current density is achieved. Alternatively, by increasing the operating current density, the same amount of the metal value may be produced in a given time period, but with less active cathode surface area (i.e., fewer or smaller cathodes 110, which corresponds to lower capital equipment costs and lower operating costs).

In accordance with one aspect of an exemplary embodiment of the present invention, the temperature of metal-bearing electrolytic solution 107 in electrowinning cell 100 is maintained at from about 40° F. to about 150° F. In accordance with one preferred embodiment, metal-bearing electrolytic solution 107 is maintained at a temperature of from about 90° F. to about 140° F. Higher temperatures may, however, be advantageously employed. For example, in direct electrowinning operations, temperatures higher than 140° F. may be utilized. Alternatively, in certain applications, lower temperatures may advantageously employed. For example, when direct electrowinning of dilute copper-containing solutions is desired, temperatures below 85° F. may be utilized.

The operating temperature of metal-bearing electrolytic solution 107 in electrowinning cell 100 may be controlled through any one or more of a variety of means well known in the art, including, for example, heat exchange, an immersion heating element, an in-line heating device (e.g., a heat exchanger), or the like, preferably coupled with one or more feedback temperature control means for efficient process control.

In accordance with an exemplary embodiment of the present invention, the acid concentration in the metal-bearing electrolytic solution 107 for electrowinning may be maintained at a level of from about 5 grams to about 250 grams of acid per liter of metal-bearing electrolytic solution 107. In accordance with one aspect of a preferred embodiment of the present invention, the acid concentration in the metal-bearing electrolytic solution 107 is advantageously maintained at a level of from about 150 grams to about 205 grams of acid per liter of metal-bearing electrolytic solution 107, depending upon the upstream process.

In accordance with an exemplary embodiment of the present invention, the copper concentration in metal-bearing electrolytic solution 107 for electrowinning is advantageously maintained at a level of from about 5 grams of copper per liter ("g/L") to about 40 g/L of metal-bearing electrolytic solution 107. Preferably, the copper concentration is maintained at a level of from about 10 g/L to about 35 g/L of metal-bearing electrolytic solution 107. However, various aspects of the present invention may be beneficially applied to processes employing copper concentrations above and/or below these levels, with lower copper concentration levels of from about 0.5 g/L to about 5 g/L and upper copper concentration levels of from about 40 g/L to about 50 g/L being applied in some cases.

While various configurations and combinations of anodes 112 and cathodes 110 in the electrochemical cell 100 may be used effectively in connection with various embodiments of the present invention, a flow-through anode can be used, and electrolytic solution flow system can include an electrolyte flow manifold capable of maintaining satisfactory flow and circulation of electrolyte within the electrowinning cell.

Generally speaking, any electrolytic solution pumping, circulation, or agitation system capable of maintaining satisfactory flow and circulation of metal-bearing electrolytic solution 107 between the series of electrodes 104 in an electrowinning cell 100 such that the process specifications described herein are practicable and may be used in accordance with various embodiments of the present invention.

In accordance with an exemplary embodiment of the present invention, the metal-bearing electrolytic solution 107 flow rate is maintained at a level of from about 0.05 gallons per minute per square foot of active cathode 110 to about 30 gallons per minute per square foot of active cathode 110. Preferably, the metal-bearing electrolytic solution 107 flow rate is maintained at a level of from about 0.1 gallons per minute per square foot of active cathode 110 to about 0.75 gallons per minute per square foot of active cathode 110. It should be recognized that the optimal operable metal-bearing electrolytic solution 107 flow rate useful in accordance with the present invention will depend upon the specific configuration of the process apparatus as well as the electrolyte chemistry employed, and thus flow rates in excess of about 30 gallons per minute per square foot of active cathode 110 or less than about 0.05 gallons per minute per square foot of active cathode 110 may be optimal in accordance with various embodiments of the present invention. Moreover, metal-bearing electrolytic solution 107 movement within electrowinning cell 100 may be augmented by agitation, such as through the use of mechanical agitation and/or gas/solution injection devices, to enhance mass transfer.

Figure 3:
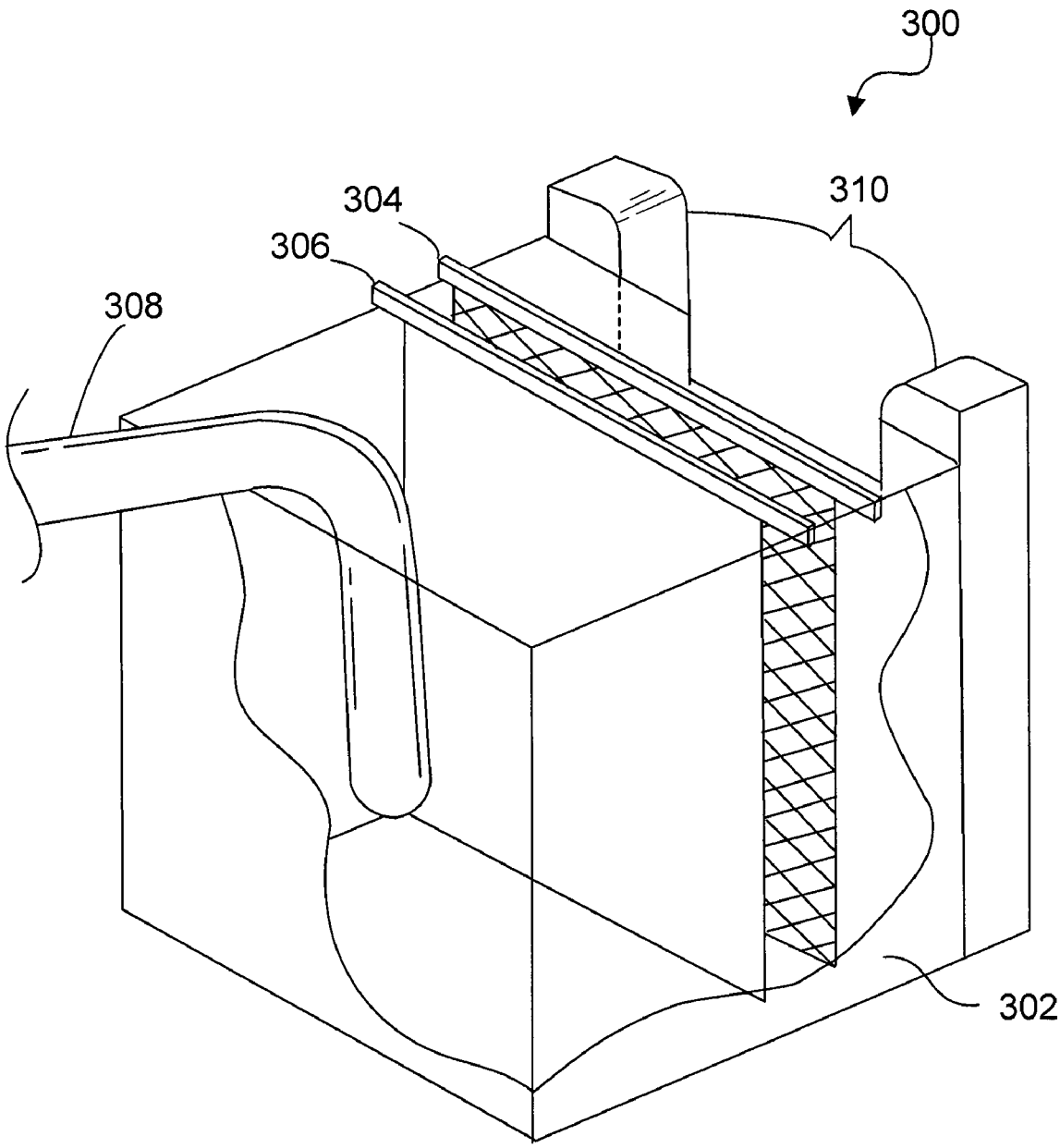
FIG. 3 is a prospective view illustrating a flow-through electrowinning cell, in accordance with an exemplary embodiment of the present invention.

Referring now to FIG. 3, an electrochemical cell in accordance with various aspects of an exemplary embodiment of the present invention is illustrated. Electrochemical cell 300 generally comprises vessel 302 configured to hold at least one anode 304, at least one cathode 306, electrolyte injection inlet 308, and outlet port 310. Although an angled electrolytic solution injection inlet configuration is illustrated in FIG. 3 for purposes of reference, any number of configurations of an electrolytic solution injection inlet 308 may be possible. Electrolyte injection inlet 308 preferably may be configured to substantially distribute flow of metal-bearing electrolytic solution 107 evenly across the active surfaces of at least one anode 304 and at least one cathode 306.

Figure 4:
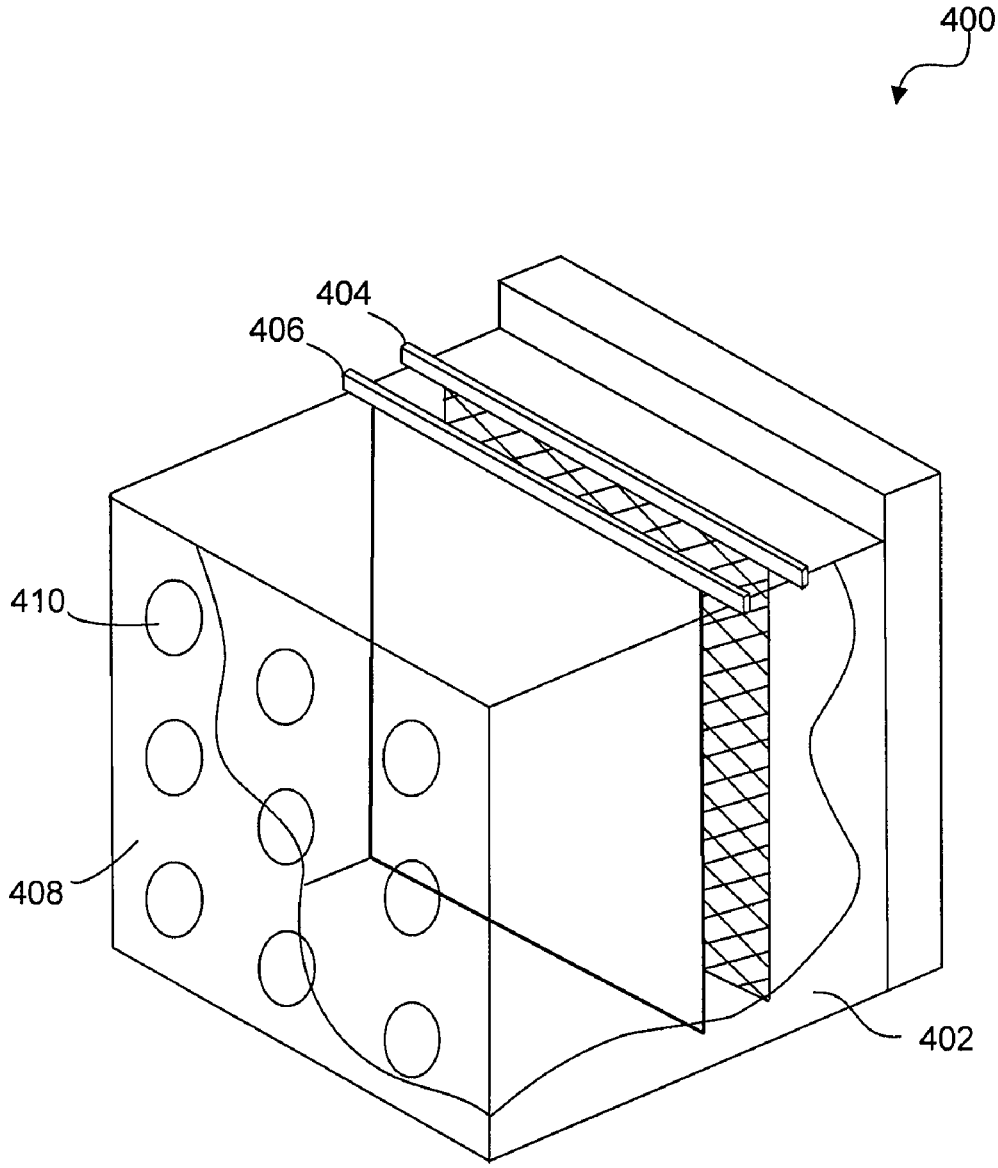
FIG. 4 is a prospective view illustrating a flow-through electrowinning cell, in accordance with an exemplary embodiment of the present invention.

Referring now to FIG. 4, an electrochemical cell in accordance with various aspects of an exemplary embodiment of the present invention is illustrated. Electrochemical cell 400 generally comprises vessel 402 configured to hold at least one anode 404, at least one cathode 406, and distributor plate 408 comprising a plurality of injection holes 410. Although an approximately horizontal electrolytic solution injection configuration is illustrated in FIG. 4 for purposes of reference, any number of configurations of differently directed and spaced injection holes 410 may be possible. For example, although injection holes 410 illustrated in FIG. 4 are approximately parallel to one another and similarly directed, configurations comprising a plurality of opposing injection streams or intersecting injection streams may be beneficial in accordance with various embodiments of the present invention. Preferably, distributor plate 408 can be configured to substantially distribute flow of metal-bearing electrolytic solution 107 evenly across the active surfaces of at least one anode 404 and at least one cathode 406.

Injection velocity of the metal-bearing electrolytic solution 107 into an electrochemical cell may be varied by changing the size and/or geometry of the holes or slots through which electrolyte enters the electrochemical cell 400. For example, with reference to FIG. 4 wherein electrolytic solution 107 feed is sent through distributor plate 403 configured having a plurality of injection holes 410, if the diameter of injection holes 410 is decreased, the injection velocity of the electrolytic solution 107 is increased, resulting in, among other things, increased agitation of the electrolytic solution 107. Moreover, the angle of injection of electrolytic solution 107 into electrochemical cell 400 relative to the cell walls and the electrodes, such as anode 404 and cathode 406, may be configured in any way desired, through any number of cell walls.

Figure 5:
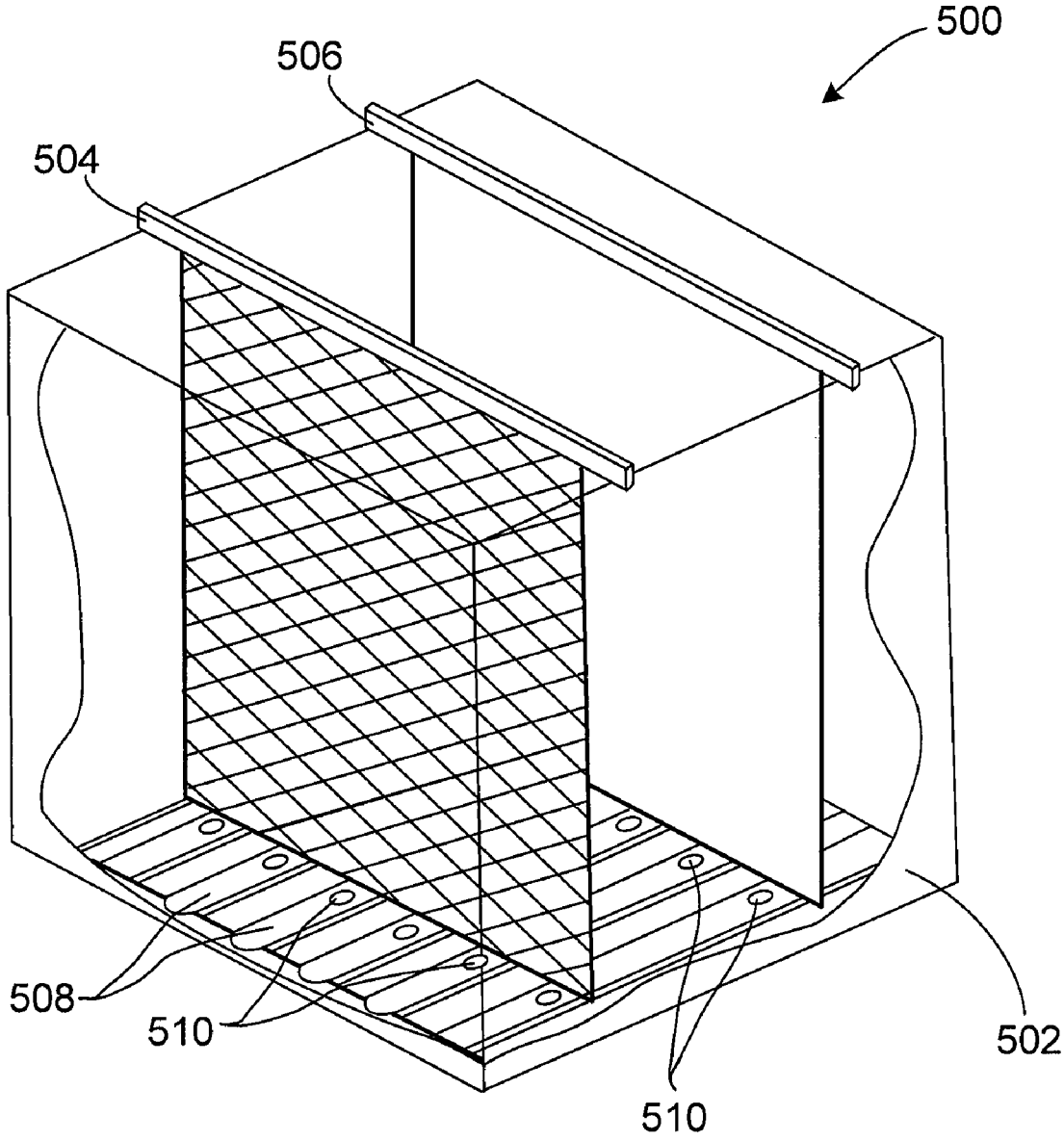
FIG. 5 is a prospective view illustrating a flow-through electrowinning cell, in accordance with an exemplary embodiment of the present invention.

Referring now to FIG. 5, an electrochemical cell in accordance with various aspects of an exemplary embodiment of the present invention is illustrated. Electrochemical cell 500 generally comprises vessel 502 configured to hold at least one anode 504, at least one cathode 506, and electrolyte flow manifold 508 comprising a plurality of injection holes 510 distributed throughout at least a portion of vessel 502. As can be seen in FIG. 5, electrolytic solution flow manifold 508 is a "floor mat" type manifold that is located on the floor of vessel 502. Flow manifold 508 preferably is configured to substantially distribute flow of metal-bearing electrolytic solution 107 evenly across the active surfaces of at least one anode 504 and at least one cathode 506.

In accordance with various embodiments of the present invention, exemplary electrochemical cells 300, 400, and 500 comprise examples of apparatus useful for implementation of an electrowinning step in an electrowinning cell 100, as illustrated in FIG. 2. These and other exemplary aspects are discussed in greater detail herein below.

In accordance with exemplary embodiments of the present invention, a flow-through anode, such as anodes 304, 404, and 504 illustrated in FIGS. 3-5, can be incorporated into any of exemplary cells 100, 302, 402 and 502 illustrated in FIGS. 1 and 3-5. Likewise, in accordance with exemplary embodiments of the present invention, a flow-through cathode, such as cathode 306, 406, and 506 illustrated in FIGS. 3-5, can be incorporated into any of exemplary cells 100, 302, 402 and 502 illustrated in FIGS. 1 and 3-5.

Referring now to FIGS. 6-11, an electrode for an electrolytic cell is illustrated in accordance with various embodiments of the present invention. An exemplary embodiment of the electrode can be a flow-through anode 600 which will be discussed in detail. It should be understood that the anode 600 discussed below in detail can be incorporated into exemplary cells 300, 400, and 500 as anodes 304, 404, and 504 respectively or into exemplary cell 100 as anodes 112.

In accordance with various embodiments, anode 600 can comprise hanger bar 602 and at least one conductor rod 612. Anode 600 may comprise hanger bar 602 and anode body 604. Anode body 604 may comprise at least one conductor rod 612 and at least one substrate 614 coupled to at least one conductor rod 612. In accordance with an exemplary embodiment, hanger bar 602 is made from copper. In accordance with an exemplary embodiment, anode body 604 is suspended from hanger bar 602. Preferably, during use, substantially all of anode body 604 is immersed in an electrolyte solution (i.e., below electrolyte fill level 116, as illustrated in FIG. 2).

Figure 6:
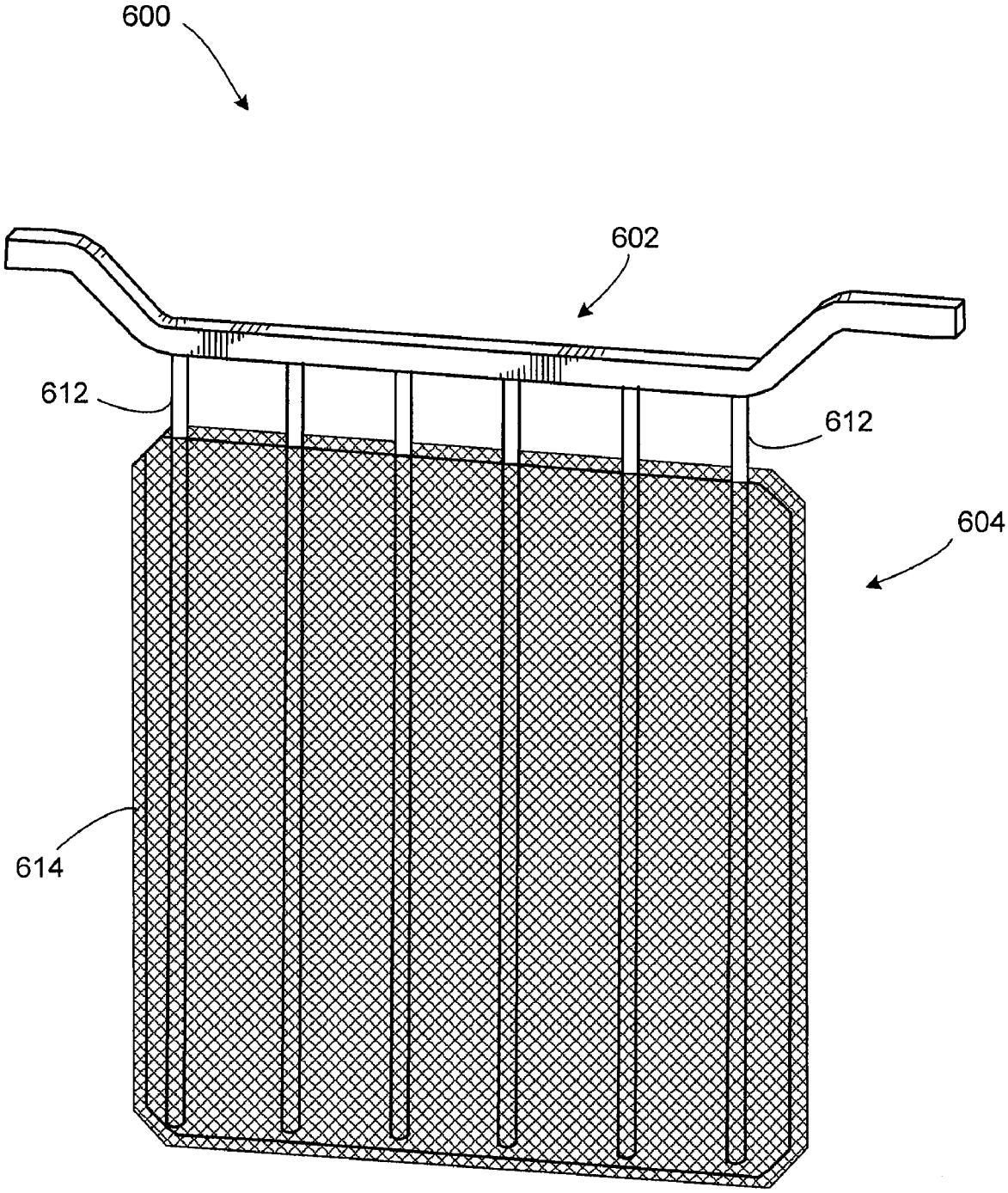
FIG. 6 is a prospective view illustrating a flow-through anode, in accordance with various embodiments of the present invention.
Figure 7:
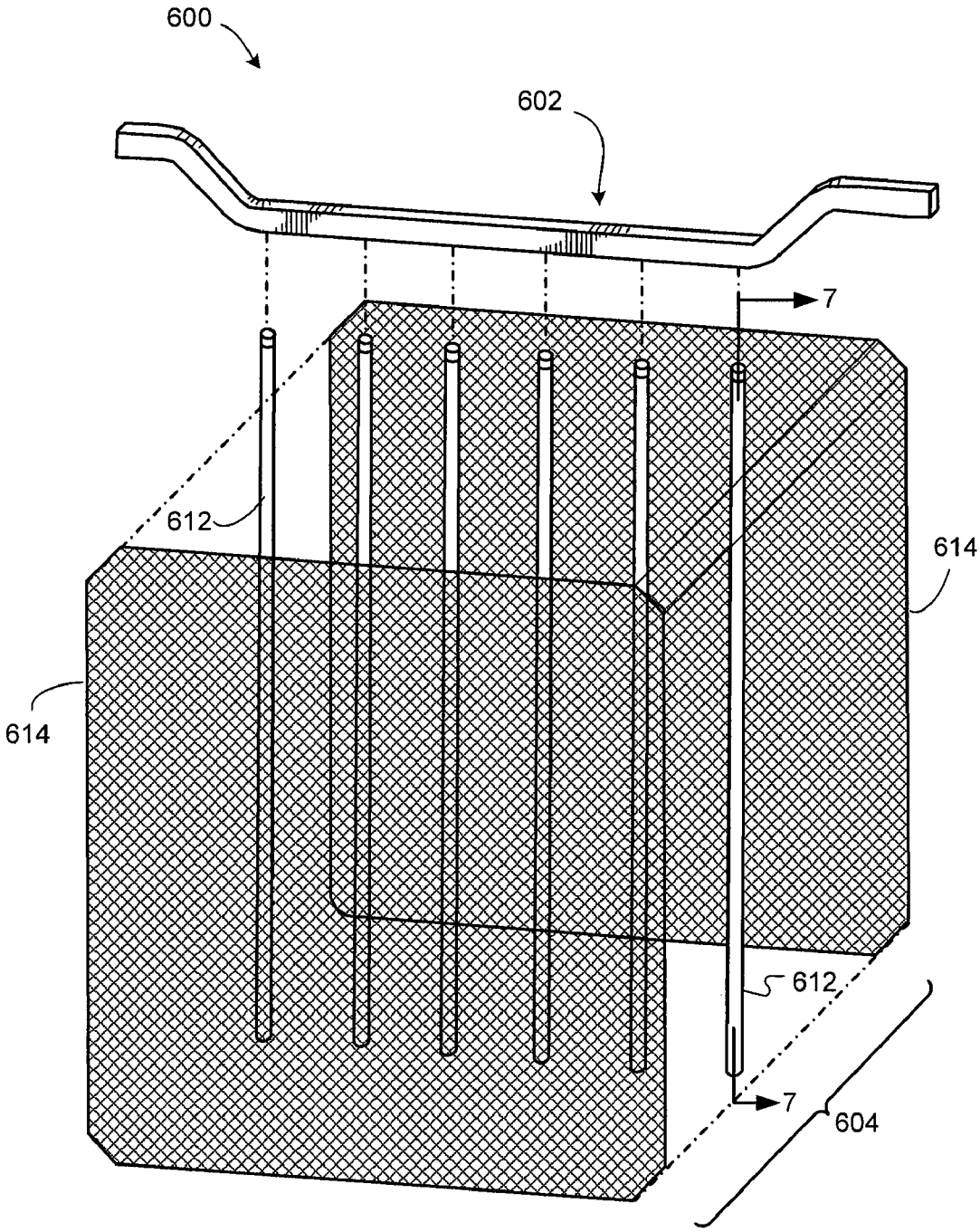
FIG. 7 is an exploded prospective view of the flow-through anode illustrated in FIG. 6, in accordance with various embodiments of the present invention.

In accordance with an exemplary embodiment, anode body 604 comprises substrate 614, as illustrated in FIGS. 6 and 7. Preferably, in accordance with an exemplary embodiment, substrate 614 comprises a mesh screen, perforated sheet or an expanded metal sheet. For example in constructing substrate 614, an expanded sheet may be made by putting slits through a metal sheet then pulling the metal sheet from all sides to create an expanded sheet having a plurality of substantially diamond-shaped holes. Substrate 614 may be constructed of any conductive material, for example, those as described herein. In various embodiments, substrate 614 comprises a valve metal or a combination of valve metals or alloys comprising at least one valve metal. In an exemplary embodiment, substrate 614 comprises titanium.

In other embodiments, anode body 604 may comprise substrate 614 configured in the form of a mesh-like substrate. In an exemplary embodiment, substrate 614 comprises a woven wire screen with about a 100×100 strand per square inch to about a 10×10 strand per square inch, preferably from about an 80×80 strand per square inch to about a 30×30 strand per square inch, and more preferably about a 60×60 strand per square inch to about a 40×40 strand per square inch. However, other various rectangular and irregular geometric mesh configurations may be used. In various embodiments, substrate 614 may be somewhat more porous, for example, a strand every square inch. Any strand pitch may be used for construction of substrate 614. In various embodiments, substrate 614 uses an irregular pattern in which there is not a consistent pitch from side to side.

In accordance with various embodiments, substrate 614 may be fastened to conductor rods 612, and such fastening methods are well known in the art and may include, for example, welding, adhesives, braided wire, fasteners, staples, and the like. Any means now known or hereafter developed in the future that may hold substrate 614 to rods 612 may be used as long as a portion of the substrate 614 is in electrical conductive contact to at least one of the conductor rods 612. In accordance with one exemplary embodiment, substrate 614 may be welded to conductor rods 612.

Conductor rods 612, which are coupled to hanger bar 602, can be of any number. In an aspect of the present invention, the number of conductor rods can be from about 4 to about 12, or from about 6 to about 8, or about 6, or about 8. In various embodiments, at least two of substrate 614 can be coupled to either side of conductor rods 612, then the edges of the at least two of substrate 614 can be coupled together. In such a configuration, the at least two of substrate 614 create an envelope around a plurality of conductor rods 612. The coupling of the edges of the at least two of substrate 614 can increase rigidity and/or increase lifetime of anode body 604. In addition, the coupling of the edges of the at least two of substrate 614 can improve the coupling of substrate 614 to conductor rods 612 and/or improve conductivity of anode body 604.

In accordance with another aspect of an exemplary embodiment of the present invention, substrate 614 may comprise any electrochemically active coating on a surface of substrate 614. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures, alloys and combinations thereof. A mixture of tantalum oxide and iridium oxide can be used as an electrochemically active coating on substrate 614. Preferably, in accordance with one exemplary embodiment, substrate 614 comprises a titanium mesh with a coating comprised of a mixture of iridium oxide and tantalum oxide.

Figure 8A:
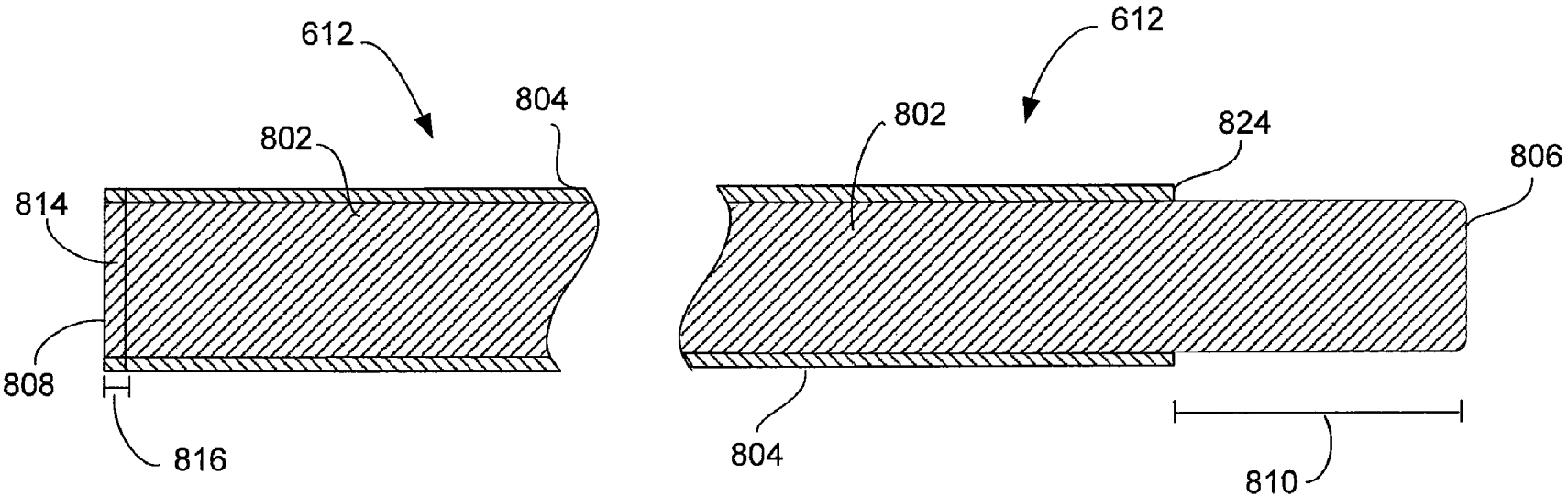
FIG. 8A is a cross-sectional view of a conductor rod taken along line 7-7 of FIG. 7, in accordance with an exemplary embodiment of the present invention.

In accordance with various embodiments, conductor rod 612 contains core 802 and outer layer 804, as illustrated in FIG. 8A, which is a cross-sectional view of conductor rod taken along line 7-7 of FIG. 7. Outer layer 804 can cover essentially the entirety of core 802 below hanger bar 602. Core 802 comprises a conductive material, for example, but not limited to, copper, copper alloy, aluminum, copper aluminum alloy, stainless steel, titanium, gold, combinations thereof, or any other electrically-conductive materials suitable for core 802.

Outer layer 804 can be any conductive metal, such as, for example, a valve metal. Outer layer 804 can be formed of one of the so-called valve metals, including titanium, tantalum, zirconium, and niobium. For example, titanium may be alloyed with nickel, cobalt, iron, manganese, or copper can form a suitable outer layer 804. In an exemplary embodiment, outer layer 804 comprises titanium because, among other things, titanium is rugged and corrosion-resistant and in that regard can extend the lifetime of anode 600. In accordance with an exemplary embodiment, outer layer 804 can be made from titanium and may be cold rolled onto core 802 or clad thereon.

In accordance with an exemplary embodiment, conductor rod 612 includes first end 806 and second end 808 which is distal to first end 806. First end 806 includes attachment portion 810. Attachment portion 810 includes exposed core 802 and does not include outer layer 804 of conductor rod 612. In an exemplary embodiment, if core 806 has outer layer 804 that has been cold-rolled over the surface of core 804, a portion of outer layer 804 may be cut near first end 806 to create attachment portion 810.

Second end 808 of conductor rod 612 contains cap 814. Cap 814 fits within removed portion 816 of core 802. Removed portion 816 of core 802 may be removed by any suitable method. In accordance with an exemplary embodiment, removed portion 816 of core 802 is removed by contacting it with an acid. As will be apparent to those skilled in the art, cap 814 may comprise a myriad of different configurations as compared to that in FIG. 8A. For example, cap 814 may be a disc, having a diameter equal to the outer diameter of conductor rod 612 and attached to the end of conductor rod 612 using means known to those skilled in the art or hereafter developed, such as for example, an adhesive, welding, fasteners, combinations thereof, and the like. Other configurations for cap 814 can include an edge that is greater than the diameter of conductor rod 612. In such configurations, cap 814 can be fastened using threads, forced on, crimped, adhesives, welding, fasteners, combinations thereof, and the like. Any configuration of cap 814 known to those skilled in the art or developed in the future may be used at second end 808 of conductor rod 612. Use of cap 814 is advantageous to prevent acid from eating away core 802 of conductor rod 612 when anode 600 is used in electrowinning applications.

In accordance with another aspect of an exemplary embodiment of the present invention, conductor rod 612 may also optionally comprise any electrochemically active coating. Exemplary coatings include those provided from platinum, ruthenium, iridium, or other Group VIII metals, Group VIII metal oxides, or compounds comprising Group VIII metals, and oxides and compounds of titanium, molybdenum, tantalum, and/or mixtures, alloys and combinations thereof. A mixture of tantalum oxide and iridium oxide can be used as an electrochemically active coating on conductor rod 612.

Figure 8B:
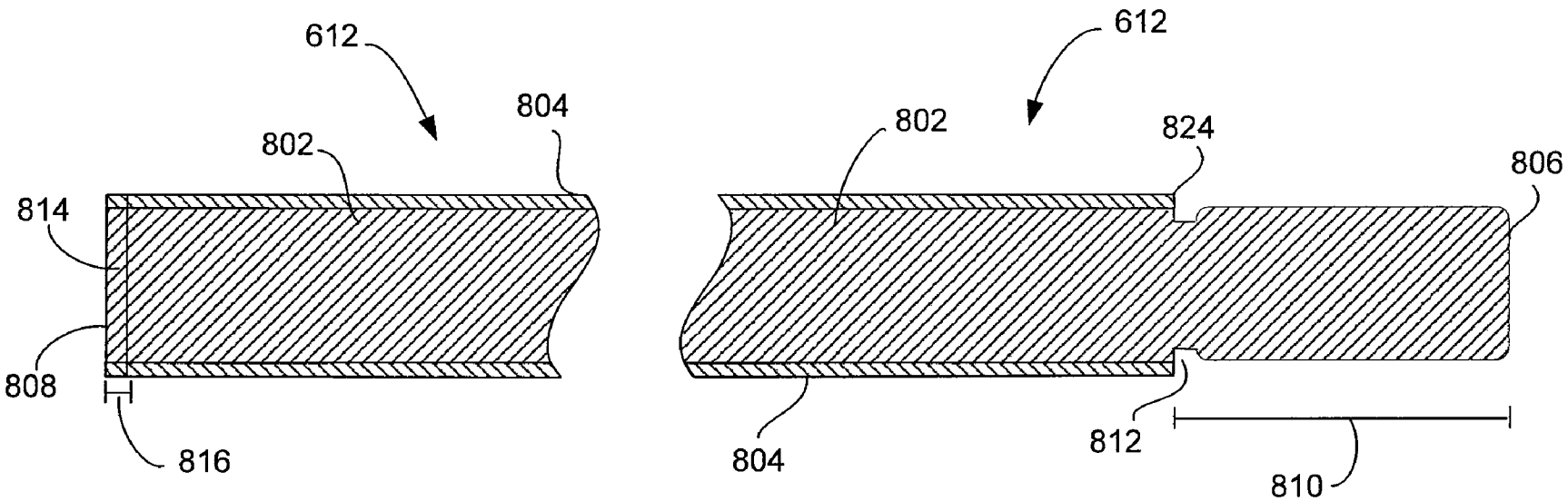
FIG. 8B is a cross-sectional view of a conductor rod taken along line 7-7 of FIG. 7, in accordance with an exemplary embodiment of the present invention.

In accordance with various embodiments, conductor rod 612 contains core 802 and outer layer 804, as illustrated in FIG. 8B, which is a cross-sectional view of conductor rod taken along line 7-7 of FIG. 7. Core 802 and outer layer 804 comprise any materials discussed herein. In accordance with an exemplary embodiment, core 802 can comprise copper and outer layer 804 can be made from titanium and may be cold rolled onto core 602 or clad thereon.

In accordance with an exemplary embodiment, conductor rod 612 includes first end 806 and second end 808 which is distal to first end. First end 606 includes attachment portion 810. Attachment portion 810 includes exposed core 802 and does not include outer layer 804 of conductor rod 612.

In an exemplary embodiment, circumferential groove 812 may be inscribed in core 802 adjacent to outer layer 804. More specifically, the circumferential groove 812 may be machined into core 802. If core 802 has outer layer 804 that has been cold-rolled over the surface of core 802, a portion of outer layer 804 may be cut near first end 806 to create attachment portion 810. Once outer layer 804 is cut, a portion of outer layer 804 may be removed and the cutting of outer layer 804 may create groove 812. In an exemplary embodiment, outer layer 804 can be cold-rolled or clad onto core 802 up to groove 812. Using such a method, groove 812 may be used as a guide for rolling outer layer 804 over core 802 such that a length of attachment portion 810 is essentially equivalent across a plurality of conductor rods 612. In an exemplary embodiment, grooves can be configured to hold a seal member (not shown) for example a synthetic rubber O-ring type seal, or a fluoropolymer elastomer O-ring type seal.

Figure 9:
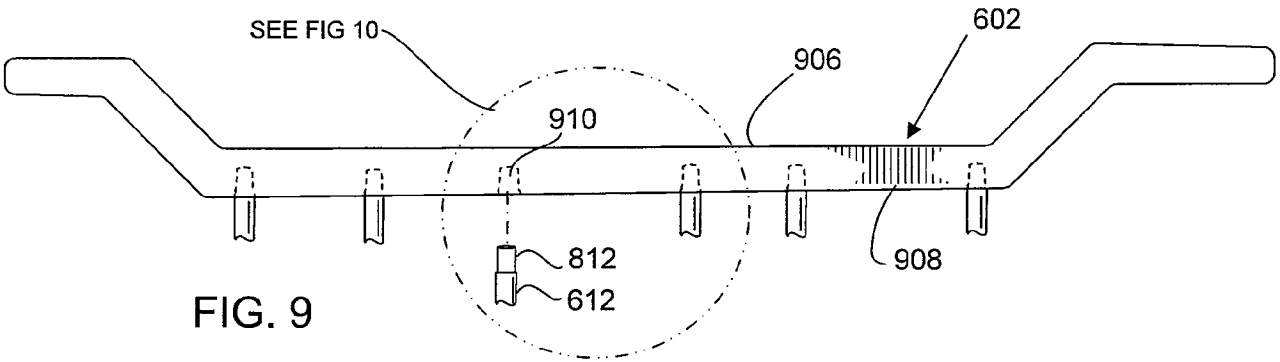
FIG. 9 is a front exploded view illustrating a hanger bar and a portion of a plurality of conductor rods, in accordance with various embodiments of the present invention.
Figure 10:
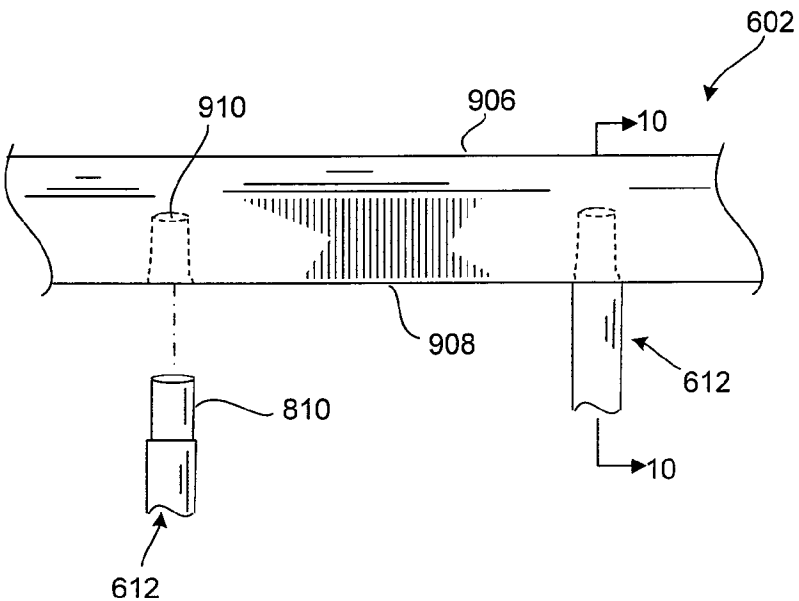
FIG. 10 is an enlarged view of the portion highlighted in FIG. 9, in accordance with various embodiments of the present invention.

Referring now to FIGS. 9 and 10, hanger bar 602 will be discussed. In accordance with an exemplary embodiment, hanger bar 602 can be a "steerhead" configuration, which is configured to be positioned horizontally in an electrowinning cell. Other configurations for hanger bar 602 may, however, be utilized, such as, for example, substantially straight configurations, multi-angled configurations, offset configurations and the like. In accordance with an exemplary embodiment, hanger bar 602 contains an upper surface 906 and a lower surface 908. In accordance with an exemplary embodiment, the lower surface 908 contains a plurality of recessed holes 910 that extend within the hanger bar, upwardly along a vertical axis.

In accordance with an exemplary embodiment, at least one conductor rod 612 can be coupled with hanger bar 602 and suspended therefrom, as illustrated in FIGS. 6, 9 and 10. In accordance with an exemplary embodiment, attachment portion 810 of conductor rod 612 can be inserted into recessed hole 910 of hanger bar 602. Preferably, in accordance with an exemplary embodiment, attachment portion 810 of conductor rod 612 is press fit within recessed hole 910. Attachment portion 810 can be inserted such that core 802 is flush within recessed hole 910 thereby providing for a suitable electrically conductive connection between core 802 and hanger bar 602.

Figure 11A:
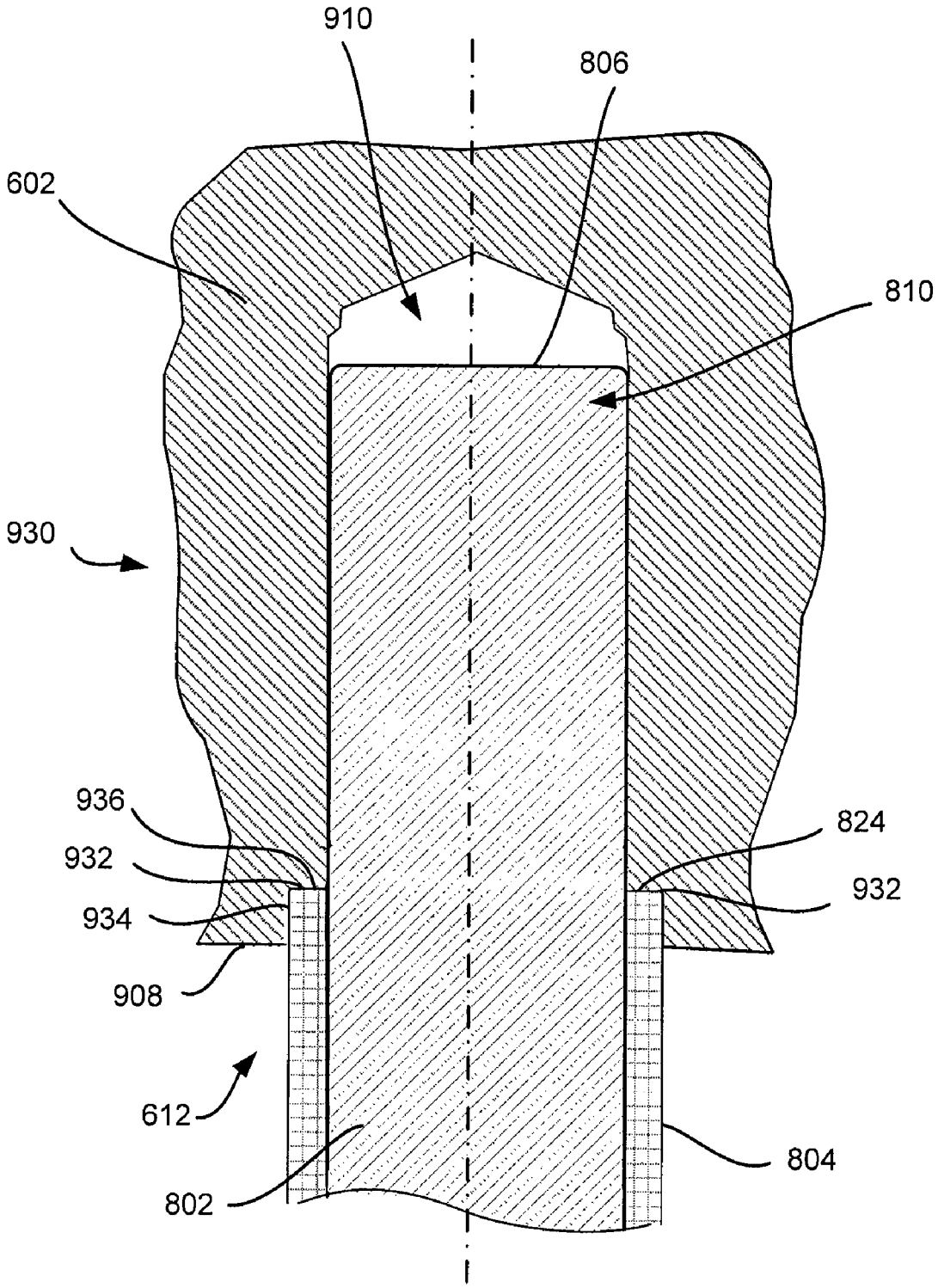
FIG. 11A is a partial cross-sectional view taken along line 10-10 of FIG. 10, in accordance with an exemplary embodiment of the present invention.
Figure 11B:
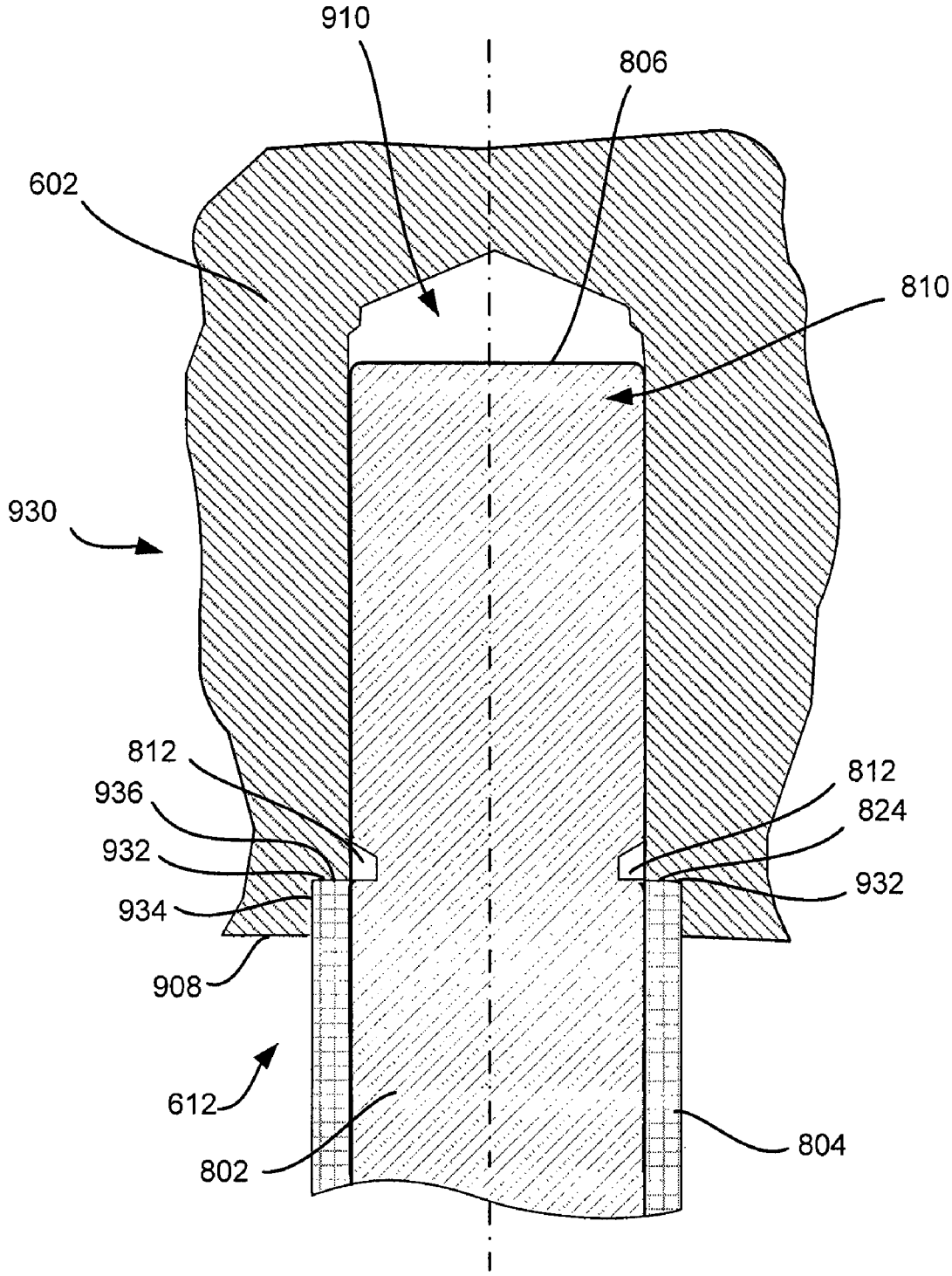
FIG. 11B is a partial cross-sectional view taken along line 10-10 of FIG. 10, in accordance with an exemplary embodiment of the present invention

With reference to FIGS. 11A and 11B, connection 930 is illustrated as a cross sectional view along the line 10-10 of FIG. 10. Connection 930 comprises one of the plurality of recessed holes 910 and attachment portion 810 fastened in the one of the plurality of recessed holes 910. In an exemplary embodiment, connection 930 can be a press fit attachment of attachment portion 810 into one of plurality of recessed holes 910 such that attachment portion 810 is forced into one of plurality of recessed holes 910.

Referring now to FIGS. 11A and 11B and in accordance with an exemplary embodiment, attachment portion 810 of conductor rod 612 is inserted into recessed hole 910 of hanger bar 602. Preferably, in accordance with an exemplary embodiment, attachment portion 810 of conductor rod 612 is press fit within recessed hole 910. Attachment portion 810 is inserted such that core 802 is flush within recessed hole 910 thereby providing for a suitable electrically conductive connection between core 802 and hanger bar 602.

In another aspect of an exemplary embodiment, attachment portion 810 may be tapered, making it easier to form connection 930 when meeting an end of the end of the forward end of attachment portion 810 into one of plurality of recessed holes 910. In addition, tapering of attachment portion 810 can be advantageous when connection 930 is a press fit since a force is only necessary when the taper is equal to or greater than the diameter of the one of the plurality of recessed holes 910. In an exemplary embodiment, attachment portion 810 is made out of copper and, as such, may be malleable under pressure during a press fit for connection 930. In addition, hanger bar 602 may be made of copper and, as such, may be somewhat malleable which may be advantageous in creating a press fit for connection 930. In an exemplary embodiment, connection 930 comprising attachment portion 810 and one of the plurality of recessed holes 610 creates an electrical conductive interface between hanger bar 602 and conductor rod 612.

Other attachment means may be used for connection 930, for example, threads, barbed surfaces, chamfer surfaces, lock-tight fittings, and combinations thereof. In addition, secondary materials, such as adhesives, welds, splints, deformable members, and the like can be used to reinforce connection 930.

With continual reference to FIGS. 11A and 11B, seal 932 is illustrated in accordance with another aspect of exemplary embodiments of the present invention. Seal 932 can be created during a press fit of connection 930 between attachment portion 810 and one of the plurality of recessed holes 910. In an exemplary embodiment, plurality of recessed holes 910 comprises notch 934. Notch 934 can be an indentation in lower surface 908 of hanger bar 602 having end 936 of notch 934 which is substantially parallel to the plane of lower surface 908. Notch 934 typically has a diameter which is greater than the diameter of the plurality of recessed holes 910. In an aspect of an exemplary embodiment, a diameter of notch 934 is greater than an outer diameter of outer surface 804 of conductor rod 612.

In accordance with another aspect of an exemplary embodiment, seal 932 is at an interface of end 936 of notch 934 and forward edge 824 of outer surface 804. Forward surface 824 of outer surface 804 is essentially perpendicular to the length of conductor rod 612. As will be appreciated by those skilled in the art, to optimize performance of seal 932, a surface of forward edge 824 of outer surface 804 and a surface of end 936 of notch 934 should be essentially smooth and flat. If an angle is used for either the forward edge 824 of the outer surface 804 or end 936 of notch 934, as will be appreciated by those skilled in the art, such angles should be complimentary to optimize seal 932.

Seal 932 essentially isolates connection 930. For example, if anode 600 is utilized in electrowinning for copper, seal 932 can isolate connection 930 from acid fumes from the electrolytic cell. It is advantageous to isolate connection 930 from acid fumes so that the integrity of connection 930 is not affected by etching effects of acid fumes to the inter wall of one of the plurality of recessed holes 910 and/or outer surface of attachment portion 810. In this regard, use of seal 932 can ensure greater lifetime of anode 600. Seal 932 can include a compressible ring, a polymeric ring or grommet, or any other such seal interfaces that are now known to those skilled in the art or hereafter developed. As will be appreciated by those skilled in the art, if such a seal interface is employed between end 936 of notch 934 and leading edge 824 for seal 932, it is preferred that such a seal interface is impermeable to whichever solution or gas from which seal 932 is isolating connection 930, or at least the seal interface does not communicate such solution or gas into connection 930.

With reference to FIG. 11B, in an exemplary embodiment, groove 812 assists in press fit of connection 930 such that attachment portion 810 may be deformed as it is press fit into one of plurality of recessed holes 910 and as such the deformation of attachment portion 810 may move some material into groove 812. In an exemplary embodiment, groove 812 can be configured to hold a seal member, such as, for example, a synthetic rubber O-ring type seal or a fluoropolymer elastomer O-ring type seal.

According to various embodiments, the present invention provides methods of making an electrode useful for electrowinning a metal value. In various embodiments, the method can include cladding core 802 with outer layer 804 and exposing an attachment portion to 810. As discussed herein, outer layer 804 can be cold-rolled over core 802. In another exemplary embodiment of the present invention, core 802 may be dipped in a solution to create outer layer 804. Exposing attachment portion 810 can include cutting a portion of outer layer 804 and removing the cut portion of outer layer 804 to expose attachment portion 810 of core 802. In various embodiments, the method can include capping an end of conductor rod 612. The capped end is distal to attachment portion 810. In an exemplary embodiment, the method can include etching a portion of core 802 distal to attachment portion 810. The etching of core 802 creates a portion that is removed to provide space for attachment of cap 814. The method can also include welding cap 814 to conductor rod 612. In various embodiments, the method can include creating a plurality of recessed holes 910 in hanger bar 602. Creating a plurality of recessed holes 910 can include drilling, machining, etching, and the like. In an exemplary embodiment of the present invention, the method can include creating a recessed notch 934 around a circumference of each of the plurality of recessed holes 910.

In various embodiments, the method can include connecting at least one conductor rod 612 to hanger bar 602. In an exemplary embodiment, the method can include press fitting attachment portion 810 into one of plurality of recessed holes 910. The method can include creating connection 930 by mating attachment portion 810 with one of plurality of recessed holes 910. The method can include reinforcing connection 930 and such reinforcement can include applying an adhesive, inserting a shim, welding, applying a fastener, and combinations thereof.

In an exemplary embodiment, the method can include creating seal 932. Seal 932 can be created by interfacing front surface 824 of outer layer 804 with end 936 of notch 934. In an exemplary embodiment, the method can include isolating connection 930. Seal 932 can essentially isolate connection 930. In various embodiments, the method can include coating conductor rod 612 with an electrochemically active coating.

In various embodiments, the method can include attaching at least one substrate 614 to at least one conductor rod 614. In an exemplary embodiment, the method can include coating at least a portion of substrate 614. Attaching substrate 614 to at least one conductor rod 612 can include welding, braiding, stapling, fastening, and/or combinations thereof. In an exemplary embodiment, the method can include attaching a second substrate 614 to at least one conductor rod 612. The method can include coating at least a portion of substrate 614 with an electrochemically conductive coating.

The present invention has been described above with reference to a number of exemplary embodiments. It should be appreciated that the particular embodiments shown and described herein are illustrative of the present invention and its best mode and are not intended to limit in any way the scope of the present invention as set forth in the claims. Those skilled in the art having read this disclosure will recognize that changes and modifications may be made to the exemplary embodiments without departing from the scope of the present invention. For example, various aspects and embodiments of this invention may be applied to electrowinning of metals other than copper, such as nickel, zinc, cobalt, and others. Although certain preferred aspects of the present invention are described herein in terms of exemplary embodiments, such aspects of the present invention may be achieved through any number of suitable means now known or hereafter devised. Accordingly, these and other changes or modifications are intended to be included within the scope of the present invention.

What is claimed is:

1. An electrode for an electrowinning process comprising:

a hanger bar including a recessed hole having an interior surface; and an electrode body comprising:

a conductor rod press fit into said recessed hole, wherein said conductor rod comprises an attachment portion having a core and a second portion comprising said core and an outer layer, wherein an outer surface of said attachment portion is in contact said interior surface.

2. The electrode according to claim 1, further comprising a substrate coupled to said conductor rod.

3. The electrode according to claim 1, wherein said core is selected from the group consisting of copper and aluminum.

4. The electrode according to claim 1, wherein said outer layer is a valve metal.

5. The electrode according to claim 4, wherein said valve metal is titanium.

6. The electrode according to claim 2, wherein said substrate comprises titanium.

7. The electrode according to claim 2, wherein said substrate comprises an electrochemically active coating.

8. An electrode for an electrowinning process comprising:

a hanger bar comprising a plurality of recessed holes;

a plurality of conductor rods comprising an outer layer and a core, each of said plurality of rods having an end portion having an exposed core;

a plurality of connections, each of said plurality of connections comprising said exposed end fastened in one of said plurality of recessed holes; and a seal formed by said outer layer and said hanger bar, said seal essentially isolating said each of said plurality of connections.

9. The electrode according to claim 8, further comprising at least one substrate coupled to said plurality of connection rods.

10. The electrode according to claim 9, further comprising a conductive layer on at least a portion of a surface of said at least one substrate.

11. The electrode according to claim 8, wherein said at least one substrate comprises titanium.

12. The electrode according to claim 8, wherein said core comprises copper.

13. The electrode according to claim 8, wherein said outer layer comprises titanium.

14. The electrode according to claim 8, wherein said exposed core comprises an annular groove.

15. A method for constructing an electrode, the method comprising:

cladding an essentially cylindrical core with a metallic outer layer to create a conductor rod;

exposing an attachment portion of said core at a first end of said conductor rod;

creating a hole in a hanger bar;

press fitting said attachment portion of said conductor rod into said hole; and coupling at least one substrate to said conductor rod.

16. The method according to claim 15, further comprising creating a seal between a portion of said outer layer and said hole.

17. The method according to claim 15, further comprising coating a portion of a surface of said at least one substrate with an electrochemically active coating.

18. The method according to claim 15, further comprising creating a connection of said conductor rod to said hanger rod.

19. The method according to claim 15, further comprising capping a distal end of said conductor rod.

20. The method according to claim 15, further comprising creating a recess around said hole and creating a seal between a portion of said outer layer and said recess.

* * * * *